US011377988B2

(12) United States Patent
Noumi et al.

(10) Patent No.: US 11,377,988 B2
(45) Date of Patent: Jul. 5, 2022

(54) TAIL PIPE

(71) Applicant: FUTABA INDUSTRIAL CO., LTD., Aichi (JP)

(72) Inventors: Yuki Noumi, Aichi (JP); Katsuhiko Kainuma, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 260 days.

(21) Appl. No.: 16/777,205

(22) Filed: Jan. 30, 2020

(65) Prior Publication Data

US 2020/0248598 A1 Aug. 6, 2020

(30) Foreign Application Priority Data

Feb. 4, 2019 (JP) ..... JP2019-018056

(51) Int. Cl.
*F01N 1/00* (2006.01)
*F01N 13/00* (2010.01)

(52) U.S. Cl.
CPC ..... *F01N 1/003* (2013.01); *F01N 13/007* (2013.01); *F01N 2470/04* (2013.01); *F01N 2470/20* (2013.01); *F01N 2470/24* (2013.01)

(58) Field of Classification Search
CPC ..... F01N 1/003; F01N 1/026; F01N 13/20; F01N 2470/08; F01N 2470/20; F01N 2470/30; F01N 2470/24; F01N 13/007; F01N 2470/04
USPC ..... 181/227, 228
See application file for complete search history.

(56) References Cited

U.S. PATENT DOCUMENTS 2,229,672 A * 1/1941 Rauen ..... F01N 1/02 181/256
2,929,462 A * 3/1960 Nowak ..... F01N 1/24 181/252
4,325,459 A * 4/1982 Martin ..... F01N 1/24 181/248

(Continued)

FOREIGN PATENT DOCUMENTS

JP S56157316 U 11/1981
JP S58159832 U 10/1983

(Continued)

OTHER PUBLICATIONS

English translation of the Japanese Notice of Reasons for Refusal dated Nov. 17, 2020 for corresponding Japanese Application No. 2019-018056.

(Continued)

*Primary Examiner* — Jeremy A Luks
(74) *Attorney, Agent, or Firm* — David D. Brush; Westman, Champlin & Koehler, P.A.

(57) ABSTRACT

Provided is a tail pipe in which a silencing effect at a discharge port is obtained. One aspect of the present disclosure is a tail pipe including: an inner tube including a discharge port configured such that an exhaust gas is discharged therefrom; an outer tube arranged so as to form a space between the outer tube and the inner tube by surrounding an outer peripheral surface of the inner tube, an upstream end of the outer tube in a flow direction of the exhaust gas being closed; and at least one communication hole allowing communication between an interior of the inner tube and the space.

8 Claims, 5 Drawing Sheets

(56) References Cited

U.S. PATENT DOCUMENTS

| | | | | | |
|---|---|---|---|---|---|
| 4,589,515 | A * | 5/1986 | Omura | F01N 13/082 | 181/227 |
| 4,926,638 | A * | 5/1990 | Kakuta | F01N 1/085 | 60/319 |
| 5,161,371 | A | 11/1992 | Deville | | |
| 5,831,223 | A * | 11/1998 | Kesselring | F01N 1/12 | 181/227 |
| 5,892,186 | A * | 4/1999 | Flugger | F01N 1/10 | 181/252 |
| 7,007,720 | B1 * | 3/2006 | Chase | F16L 59/12 | 138/110 |
| 2004/0206573 | A1 * | 10/2004 | Hsu | F01N 13/082 | 181/228 |
| 2005/0161283 | A1 * | 7/2005 | Emler | F01N 1/003 | 181/249 |
| 2006/0242952 | A1 * | 11/2006 | Muramatsu | F01N 1/084 | 60/299 |
| 2007/0151798 | A1 * | 7/2007 | Smith | F01N 13/141 | 181/256 |
| 2008/0308347 | A1 * | 12/2008 | Luttig | F01N 1/24 | 181/253 |

FOREIGN PATENT DOCUMENTS

| | | | |
|---|---|---|---|
| JP | 3021165 | U | 2/1996 |
| JP | 2005-256688 | A | 9/2005 |

OTHER PUBLICATIONS

English translation of the Chinese Office Action dated Jun. 30, 2021 for corresponding Chinese Application No. 202010079500.4.

* cited by examiner

TAIL PIPE

CROSS-REFERENCE TO RELATED APPLICATIONS

This application claims the benefit of Japanese Patent Application No. 2019-018056 filed on Feb. 4, 2019 with the Japan Patent Office, the entire disclosure of which is incorporated herein by reference.

BACKGROUND

The present disclosure relates to a tail pipe.

In an exhaust system of an internal combustion engine, a tail pipe is known that is enlarged in diameter toward an exhaust port and that has grooves spirally formed of concavities and convexities on a peripheral wall for the purpose of increasing exhaust efficiency (see Japanese Utility Model Registration No. 3021165).

In this tail pipe, exhaust flow is twisted by the grooves, and a flow velocity of the exhaust flow is thereby increased. This results in improving the exhaust efficiency.

SUMMARY

In tail pipes of exhaust systems, noise is generated by air flow produced when an exhaust gas is discharged into the atmosphere. In the above-described tail pipe, the exhaust efficiency is improved by the above-described action, but noise reduction effect cannot be expected.

In one aspect of the present disclosure, it is desirable to provide a tail pipe in which a silencing effect at a discharge port is obtained.

One aspect of the present disclosure is a tail pipe comprising: an inner tube comprising a discharge port configured such that an exhaust gas is discharged therefrom; an outer tube arranged so as to form a space between the outer tube and the inner tube by surrounding an outer peripheral surface of the inner tube, an upstream end of the outer tube in a flow direction of the exhaust gas being closed; and at least one communication hole allowing communication between an interior of the inner tube and the space.

Such a configuration allows the space inside the outer tube communicating with the interior of the inner tube to function as a resonance chamber. This results in obtaining a silencing effect at the discharge port due to a resonance effect in the space.

In one aspect of the present disclosure, the inner tube may comprise an enlarged diameter portion enlarged in diameter toward the discharge port. In such a configuration, a flow velocity of the exhaust gas is reduced by the enlarged diameter portion. This facilitates rapid and uniform mixture of the exhaust gas into the atmosphere, resulting in reducing air flow noise.

In one aspect of the present disclosure, the enlarged diameter portion may comprise a gently enlarged portion having a first taper angle, and a sharply enlarged portion having a second taper angle larger than the first taper angle. In such a configuration, the flow velocity of the exhaust gas is changed in a circumferential direction of the tail pipe by the sharply enlarged portion and the gently enlarged portion. Specifically, the exhaust gas discharged along the gently enlarged portion is likely to spread more outward in a radial direction than the exhaust gas discharged along the sharply enlarged portion. Thus, flow velocity distribution of the exhaust gas discharged from the discharge port exhibits an elliptical shape with a portion along the gently enlarged portion as a major axis. Consequently, an area where the exhaust gas contacts the atmosphere is increased, thus facilitating rapid and uniform mixture of the exhaust gas into the atmosphere. This results in facilitating reduction of air flow noise.

In one aspect of the present disclosure, the at least one communication hole may be arranged in the sharply enlarged portion. Such a configuration makes it unlikely for the exhaust gas to hit an edge portion of the at least one communication hole, thus reducing separation of the exhaust gas from an inner circumferential surface of the inner tube. Consequently, turbulent flow of the exhaust gas is unlikely to be generated on the inner circumferential surface of the inner tube, resulting in reducing air flow noise (i.e., whistling noise) to be generated when the exhaust gas passes through the at least one communication hole.

In one aspect of the present disclosure, the at least one communication hole may be shaped such that a width thereof in a circumferential direction of the inner tube changes along the flow direction of the exhaust gas. Such a configuration reduces an area where the exhaust gas hits the edge portion of the at least one communication hole, as compared with a communication hole with unchanged width in the circumferential direction. As a result, separation of the exhaust gas from the inner circumferential surface of the inner tube is reduced, thus inhibiting generation of air flow noise at the at least one communication hole.

In one aspect of the present disclosure, a downstream end of the outer tube in the flow direction of the exhaust gas may be closed. Such a configuration allows the space inside the outer tube to be an enclosed space, thus forming a Helmholtz resonator. This results in improving the silencing effect at the discharge port.

In one aspect of the present disclosure, a downstream end of the outer tube in the flow direction of the exhaust gas may be open so as to allow communication between the space and an outside of the outer tube. In such a configuration, the exhaust gas with a higher velocity discharged from the inner tube is covered by the exhaust gas with a lower velocity discharged from the outer tube, and the atmosphere exists further therearound. This causes gradual decrease in the flow velocity of the exhaust gas flowing on the outer side, thus lowering likelihood of generation of turbulent flow. As a result, generation of air flow noise due to the turbulent flow can be reduced.

BRIEF DESCRIPTION OF THE DRAWINGS

Example embodiments of the present disclosure will be described below with reference to the accompanying drawings, in which.

DETAILED DESCRIPTION OF EXEMPLARY EMBODIMENTS

1. First Embodiment

1-1. Configuration

Figure 1A:
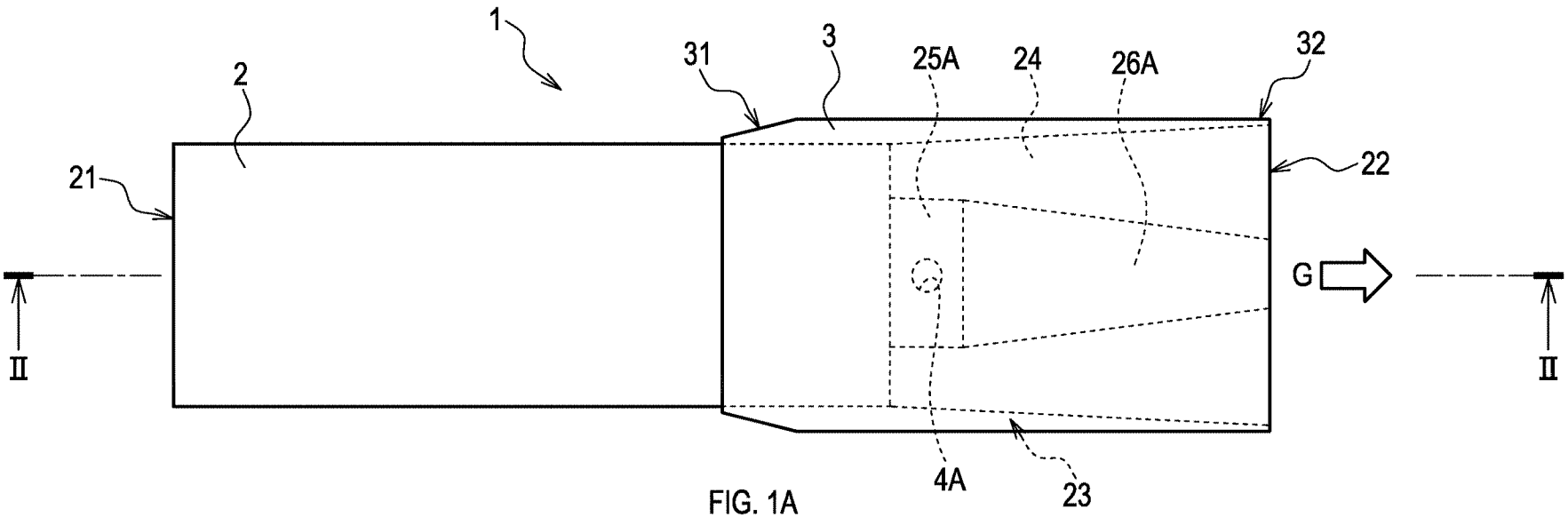
FIG. 1A is a schematic plan view of a tail pipe according to an embodiment.
Figure 1B:
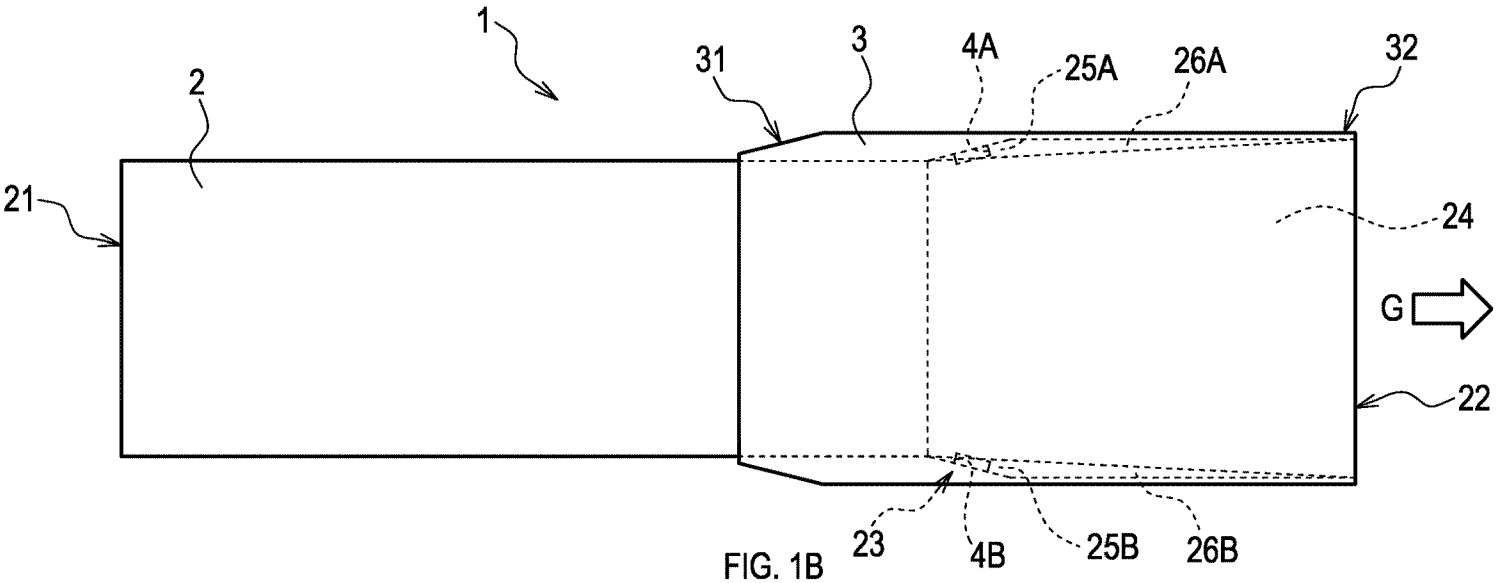
FIG. 1B is a schematic side view of the tail pipe of FIG. 1A.

A tail pipe 1 shown in FIGS. 1A and 1B is provided to an end of an exhaust gas flow path of an internal combustion engine. The tail pipe 1 discharges, into the atmosphere, an exhaust gas discharged from the internal combustion engine. The tail pipe 1 comprises an inner tube 2, an outer tube 3, and communication holes 4A and 4B.

The internal combustion engine to which the tail pipe 1 is applied is not limited in particular. Examples of such an internal combustion engine may include those used for drive or power generation in transport equipment, such as an automobile, a railroad car, a ship, and construction equipment, power generation facilities, and so on.

<Inner Tube>

The inner tube 2 is a metal pipe through which an exhaust gas G passes. The inner tube 2 comprises a supply port 21 through which the exhaust gas G is supplied, a discharge port 22 through which the exhaust gas G passed through the inner tube 2 is discharged, and an enlarged diameter portion 23 enlarged in diameter toward the discharge port 22.

The enlarged diameter portion 23 comprises a gently enlarged portion 24 having a first taper angle, and two sharply enlarged portions 25A and 25B each having a second taper angle larger than the first taper angle. The enlarged diameter portion 23 may comprise one sharply enlarged portion, or three or more sharply enlarged portions. The first taper angle is an angle between a surface of the gently enlarged portion 24 and a central axis of the inner tube 2. The second taper angle is an angle between a surface of each of the sharply enlarged portions 25A and 25B and the central axis of the inner tube 2. The first taper angle is an acute angle. The second taper angle is an acute angle or a right angle, and is preferably an acute angle.

The gently enlarged portion 24 is a portion enlarged in diameter at the constant first taper angle in a region covered by the outer tube 3 to be described later. The gently enlarged portion 24 may have a shape gradually increased in a degree of curve toward the discharge port 22, namely a flare shape. The gently enlarged portion 24 is provided, in a circumferential direction of the inner tube 2, throughout a region except where the sharply enlarged portions 25A and 25B and straight portions 26A and 26B to be described later are formed.

The sharply enlarged portions 25A and 25B are each arranged in a part of the inner tube 2 in the circumferential direction thereof. The sharply enlarged portions 25A and 25B do not overlap with the gently enlarged portion 24 when viewed along an axial direction of the inner tube 2. In other words, the gently enlarged portion 24 is not formed upstream and downstream of the sharply enlarged portions 25A and 25B.

In the present embodiment, the sharply enlarged portions 25A and 25B are each arranged in a position overlapping with the gently enlarged portion 24 when viewed along the circumferential direction of the inner tube 2. Further, the sharply enlarged portions 25A and 25B are each arranged such that an upstream end thereof (i.e., an end where enlargement in diameter starts) coincides in position with an upstream end of the gently enlarged portion 24 in the axial direction of the inner tube 2.

The sharply enlarged portions 25A and 25B each comprise, on a downstream side thereof, the straight portions 26A and 26B, respectively, having a constant inside diameter. A width of each of the straight portions 26A and 26B in the circumferential direction of the inner tube 2 becomes gradually smaller toward the discharge port 22. However, the width of each of the straight portions 26A and 26B in the circumferential direction of the inner tube 2 may be constant.

In the present embodiment, the sharply enlarged portions 25A and 25B are arranged in positions opposite each other in a radial direction of the inner tube 2 (i.e., positions spaced 180° apart in the circumferential direction of the inner tube 2). However, the sharply enlarged portions 25A and 25B do not necessarily have to be arranged in such relative positions.

<Outer Tube>

The outer tube 3 is a metal pipe arranged outside the inner tube 2 so as to surround an outer peripheral surface of the inner tube 2.

The inside diameter of the outer tube 3 excluding an upstream end 31 may be more than or equal to 1.15 times and less than or equal to 1.5 times larger than the outside diameter of the inner tube 2 excluding the enlarged diameter portion 23 (i.e., than the outside diameter of a portion having a constant outside diameter).

Figure 2:
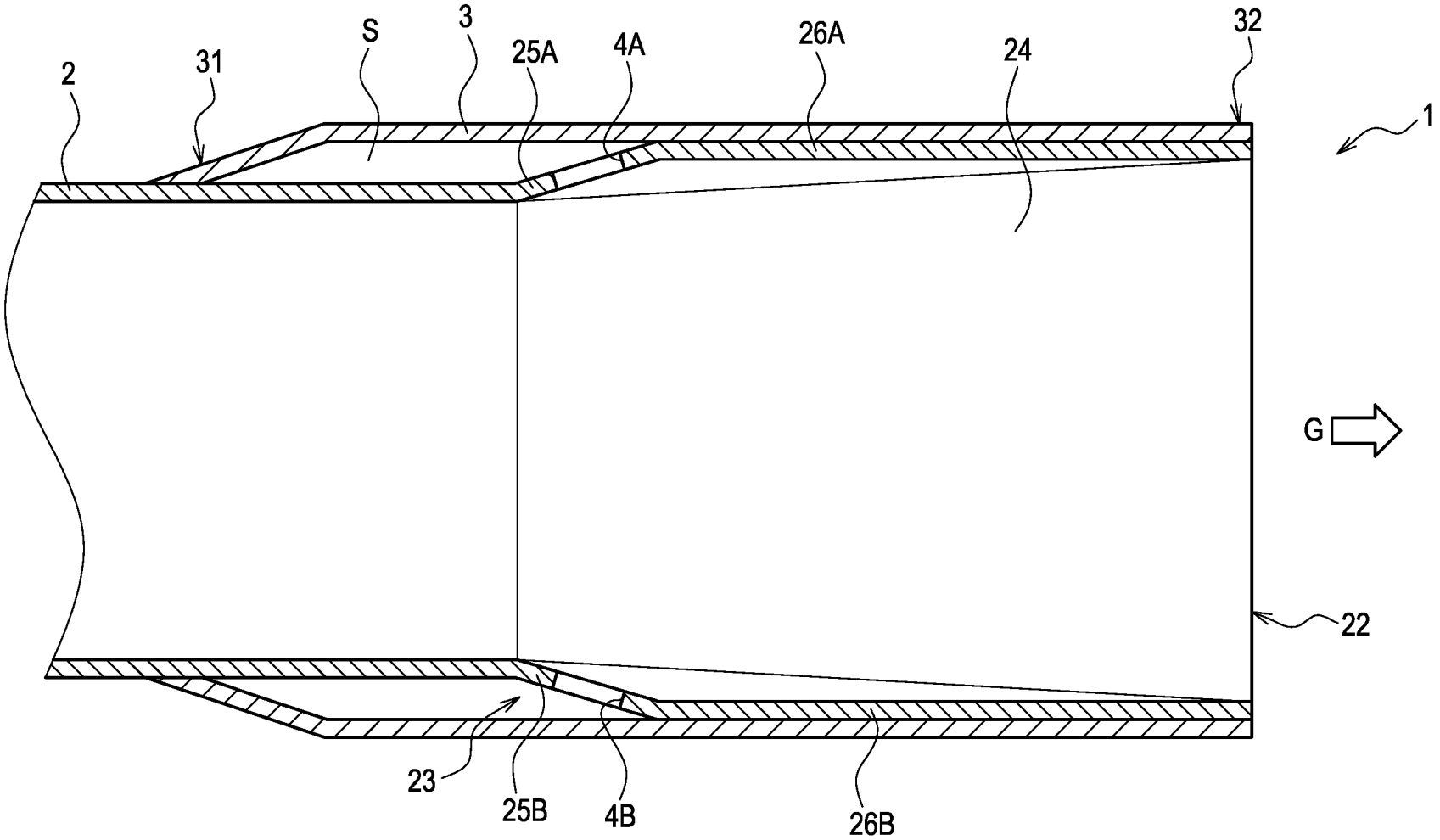
FIG. 2 is a schematic partial sectional view taken along line II-II of FIG. 1A.

As shown in FIG. 2, the outer tube 3 is arranged so as to form a space S between the outer tube 3 and the inner tube 2 by surrounding the outer peripheral surface of the inner tube 2. In the outer tube 3, the upstream end 31 and a downstream end 32 in a flow direction of the exhaust gas G are both closed.

Specifically, the upstream end 31 of the outer tube 3 is reduced in diameter toward an outside thereof in an axial direction. The upstream end 31 is fixed to a portion of the inner tube 2 located upstream of the enlarged diameter portion 23, circumferentially throughout by welding, for example.

The downstream end 32 of the outer tube 3 is fixed to downstream ends of the gently enlarged portion 24 and the straight portions 26A and 26B of the inner tube 2 (i.e., to ends forming the discharge port 22), circumferentially throughout by welding, for example. The outer tube 3 contacts outer peripheral surfaces of the straight portions 26A and 26B of the inner tube 2. The outer tube 3 excluding the upstream end 31 has a constant diameter.

A shape of a section of the outer tube 3 perpendicular to an axial direction thereof does not have to be a perfect circle. In the present embodiment, an opening of the outer tube 3 at the downstream end 32 coincides in position with the discharge port 22 of the inner tube 2 in the axial direction of the inner tube 2. However, the opening of the outer tube 3 at the downstream end 32 may be located more outside in the axial direction of the inner tube 2 than the discharge port 22 of the inner tube 2. In other words, the outer tube 3 may protrude outside of the inner tube 2 in the axial direction thereof.

From the viewpoint of design, the inner tube 2 at the discharge port 22 and the outer tube 3 at the downstream end 32 may be inclined with respect to the radial direction of the inner tube 2. In other words, the downstream ends of the inner tube 2 and the outer tube 3 may each have a cut surface inclined with respect to a plane perpendicular to the central axis of the inner tube 2.

<Communication Hole>

The communication holes 4A and 4B each allow communication between an interior of the inner tube 2 and the space S. In the present embodiment, the sharply enlarged portions 25A and 25B each contain a single hole, namely the communication holes 4A and 4B, respectively. However, the sharply enlarged portions 25A and 25B may each contain two or more communication holes as long as a silencing effect for a target frequency is obtained.

In the present embodiment, the communication holes 4A and 4B are not arranged in any portion of the inner tube 2 other than the sharply enlarged portions 25A and 25B.

Figure 3:
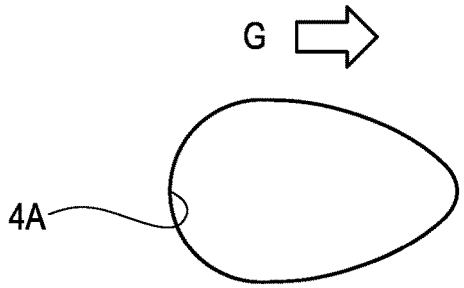
FIG. 3 is a schematic diagram showing one example of a shape of a communication hole.

Shapes of the communication holes 4A and 4B each may be an ellipse, a polygon, or the like, instead of the shown perfect circle. Further, the communication holes 4A and 4B may be shaped such that a width thereof in the circumferential direction of the inner tube 2 changes along the flow direction of the exhaust gas G. This reduces an area where the exhaust gas G hits an edge portion of each of the communication holes 4A and 4B, as compared with the communication holes 4A and 4B with unchanged width in the circumferential direction. As a result, separation of the exhaust gas G from an inner circumferential surface of the inner tube 2 is reduced, thus inhibiting generation of air flow noise at the communication holes 4A and 4B. Examples of such a shape may include a teardrop shape shown in FIG. 3, as well as a rhombus and an ellipse.

A flange or a louver protruding inward or outward of the inner tube 2 may be provided around the communication holes 4A and 4B. In other words, the communication holes 4A and 4B may be drilled by processing such as burring, and cutting to raise. Sizes of the communication holes 4A and 4B may be designed as appropriate.

1-2. Actions

In the tail pipe 1, the space S communicating with the interior of the inner tube 2 through the communication holes 4A and 4B forms a resonance chamber in the vicinity of the discharge port 22 of the inner tube 2. This results in obtaining a silencing effect at the discharge port 22.

Further, a flow velocity of the exhaust gas G is reduced by the enlarged diameter portion 23, and flow layers of the exhaust gas G having different flow velocities in the circumferential direction of the inner tube 2 are formed by the gently enlarged portion 24 and the sharply enlarged portions 25A and 25B.

These flow layers allow the exhaust gas G discharged from the discharge port 22 into the atmosphere to be assimilated and mixed into the atmosphere relatively rapidly. Thus, generation of turbulent flow and/or vortex is inhibited at the discharge port 22.

1-3. Effects

The embodiment detailed above produces the following effects.

(1a) The space S inside the outer tube 3, communicating with the interior of the inner tube 2, functions as the resonance chamber. This results in obtaining the silencing effect at the discharge port 22 due to a resonance effect in the space S.

(1b) The flow velocity of the exhaust gas G is reduced by the enlarged diameter portion 23 provided to the inner tube 2. This facilitates rapid and uniform mixture of the exhaust gas G into the atmosphere, resulting in reducing air flow noise.

(1c) The flow velocity of the exhaust gas G is changed in a circumferential direction of the tail pipe 1 by the sharply enlarged portions 25A and 25B and the gently enlarged portion 24. Specifically, the exhaust gas G discharged along the gently enlarged portion 24 is likely to spread more outward in the radial direction than the exhaust gas G discharged along the sharply enlarged portions 25A and 25B. Thus, flow velocity distribution of the exhaust gas G discharged from the discharge port 22 exhibits an elliptical shape with a portion along the gently enlarged portion 24 as a major axis. Consequently, an area where the exhaust gas G contacts the atmosphere is increased, thus facilitating rapid and uniform mixture of the exhaust gas G into the atmosphere. This results in facilitating reduction of air flow noise.

(1d) The communication holes 4A and 4B are arranged in the sharply enlarged portions 25A and 25B, respectively. This makes it unlikely for the exhaust gas G to hit the edge portion of each of the communication holes 4A and 4B, thus reducing separation of the exhaust gas G from the inner circumferential surface of the inner tube 2. Consequently, turbulent flow of the exhaust gas G is unlikely to be generated on the inner circumferential surface of the inner tube 2, resulting in reducing air flow noise (i.e., whistling noise) to be generated when the exhaust gas G passes through the communication holes 4A and 4B.

(1e) The downstream end 32 of the outer tube 3 is closed to thereby allow the space S inside the outer tube 3 to be an enclosed space, thus forming a Helmholtz resonator. This results in improving the silencing effect at the discharge port 22.

2. Second Embodiment

2-1. Configuration

Figure 4:
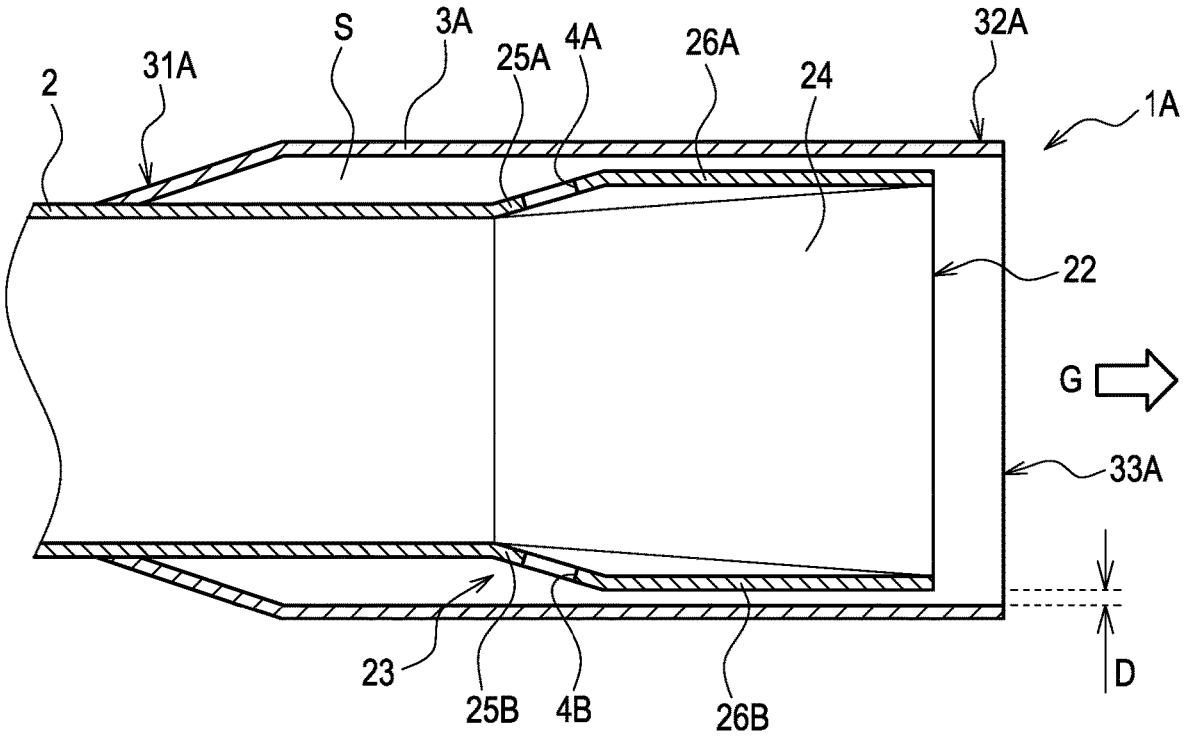
FIG. 4 is a schematic partial sectional view of a tail pipe according to an embodiment different from that of FIG. 1A.

A tail pipe 1A shown in FIG. 4 comprises the inner tube 2, an outer tube 3A, and the communication holes 4A and 4B. The inner tube 2 and the communication holes 4A and 4B are the same as those of the tail pipe 1 of FIG. 1.

The outer tube 3A is the same as the outer tube 3 of the tail pipe 1 of FIG. 1 except for a configuration of a downstream end 32A. In the outer tube 3A, an upstream end 31A in the flow direction of the exhaust gas G is closed, whereas the downstream end 32A is not closed but open.

Specifically, the downstream end 32A of the outer tube 3A has an opening 33A allowing communication between the space S and the outside of the outer tube 3A. Thus, the space S of the present embodiment is not enclosed but open to the atmosphere. The outer tube 3A except for the upstream end 31A is spaced apart from the inner tube 2.

In the present embodiment, the opening 33A of the outer tube 3A at the downstream end 32A is located more outside in the axial direction of the inner tube 2 than the discharge port 22 of the inner tube 2. In other words, the outer tube 3A protrudes outside of the inner tube 2 in the axial direction thereof. This causes the exhaust gas G discharged from the discharge port 22 to expand at the opening 33A, thus enabling further reduction of the velocity of the exhaust gas G discharged from the opening 33A. However, the opening 33A of the outer tube 3A may coincide in position with the discharge port 22 of the inner tube 2 in the axial direction of the inner tube 2.

The minimum distance D in the radial direction of the inner tube 2 between the enlarged diameter portion 23 of the inner tube 2 and the outer tube 3A (i.e., a thickness of the space S at the discharge port 22) is designed to have a size allowing the space S to function as the resonance chamber for the exhaust gas G.

2-2. Actions

In the tail pipe 1A, the exhaust gas G passes through the space S and is discharged from the opening 33A of the outer tube 3A. Thus, flow layers of the exhaust gas G having different flow velocities in the radial direction of the inner tube 2 are formed.

Further, in the tail pipe 1A, an outer-side flow of the exhaust gas G discharged from the opening 33A of the outer tube 3A reduces the velocity of a central flow of the exhaust gas G discharged from the discharge port 22 of the inner tube 2.

2-3. Effects

The embodiment detailed above produces the following effect.

(2a) The exhaust gas G with a higher velocity discharged from the inner tube 2 is covered by the exhaust gas G with a lower velocity discharged from the outer tube 3, and the atmosphere exists further therearound. This causes gradual decrease in the flow velocity of the exhaust gas G flowing on the outer side, thus lowering likelihood of generation of turbulent flow. As a result, generation of air flow noise due to the turbulent flow can be reduced.

3. Other Embodiments

Although the embodiments of the present disclosure have been described so far, the present disclosure is not limited to the above-described embodiments, and can be practiced in various forms.

Figure 5:
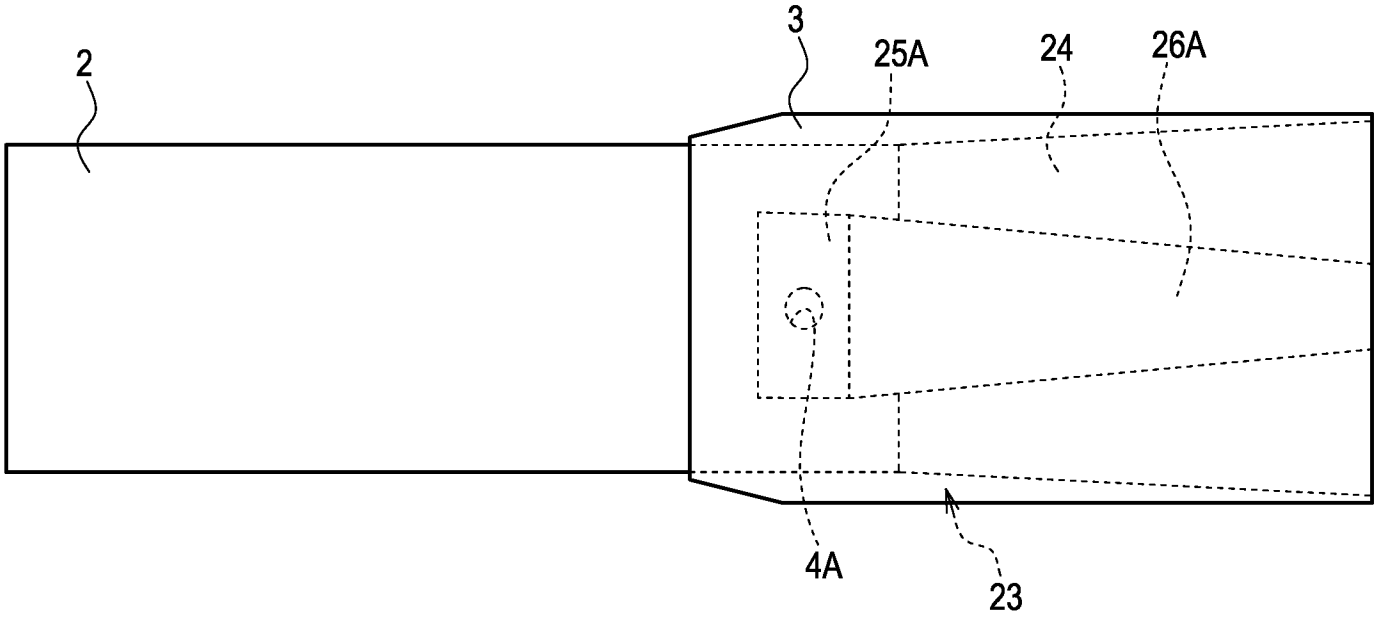
FIG. 5 is a schematic plan view of a tail pipe according to an embodiment different from those of FIGS. 1A and 4.

(3a) In the tail pipes of the above-described embodiments, the sharply enlarged portions 25A and 25B do not necessarily have to overlap with the gently enlarged portion 24 when viewed along the circumferential direction of the inner tube 2. For example, as shown in FIG. 5, the sharply enlarged portion 25A may be arranged upstream of the gently enlarged portion 24. This promotes spreading of the exhaust gas G by the enlarged diameter portion 23, thus facilitating rapid and uniform mixture of the exhaust gas G into the atmosphere.

Figure 6:
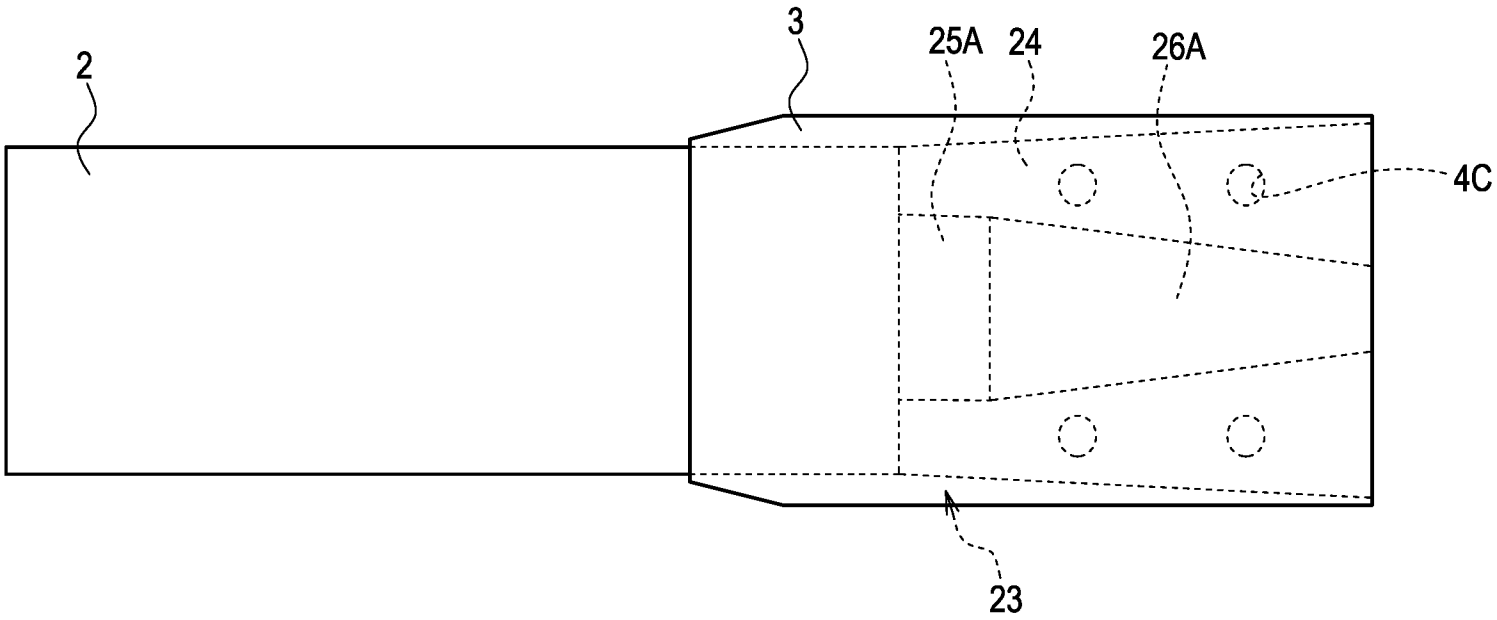
FIG. 6 is a schematic plan view of a tail pipe according to an embodiment different from those of FIGS. 1A, 4, and 5.

(3b) In the tail pipes of the above-described embodiments, the communication holes 4A and 4B do not necessarily have to be arranged in the sharply enlarged portions 25A and 25B, respectively. For example, as shown in FIG. 6, two or more communication holes 4C may be arranged in the gently enlarged portion 24. Alternatively, communication holes may be arranged in both of the gently enlarged portion and the sharply enlarged portion(s).

(3c) In the tail pipes of the above-described embodiments, the enlarged diameter portion 23 does not necessarily have to comprise the gently enlarged portion 24 and the sharply enlarged portions 25A and 25B. The enlarged diameter portion 23 may comprise only the gently enlarged portion 24. Furthermore, the inner tube 2 does not necessarily have to comprise the enlarged diameter portion 23.

(3d) The function(s) performed by a single element in the above-described embodiments may be performed by two or more elements. The function(s) performed by two or more elements may be performed by a single element. Part of the configuration of the above-described embodiments may be omitted. At least part of the configuration of the above-described embodiments may be added to or replace the configuration of the above-described other embodiments. Any modes encompassed by technical ideas specified by claim language are embodiments of the present disclosure.

What is claimed is:

1. A tail pipe comprising:

an inner tube comprising a discharge port configured such that an exhaust gas is discharged therefrom;

an outer tube arranged so as to form a space between the outer tube and the inner tube by surrounding an outer peripheral surface of the inner tube, an upstream end of the outer tube in a flow direction of the exhaust gas being closed; and at least one communication hole allowing communication between an interior of the inner tube and the space, wherein the inner tube comprises an enlarged diameter portion enlarged in diameter toward the discharge port, and wherein the enlarged diameter portion comprises:

a gently enlarged portion having a first taper angle; and a sharply enlarged portion having a second taper angle larger than the first taper angle, the sharply enlarged portion being arranged in only a part of the inner tube in a circumferential direction thereof.

2. The tail pipe according to claim 1, wherein the at least one communication hole is arranged in the sharply enlarged portion.

3. The tail pipe according to claim 1, wherein the at least one communication hole is shaped such that a width thereof in a circumferential direction of the inner tube changes along the flow direction of the exhaust gas.

4. The tail pipe according to claim 1, wherein a downstream end of the outer tube in the flow direction of the exhaust gas is closed.

5. The tail pipe according to claim 1, wherein a downstream end of the outer tube in the flow direction of the exhaust gas is open so as to allow communication between the space and an outside of the outer tube.

6. The tail pipe according to claim 2, wherein the at least one communication hole is arranged only in the sharply enlarged portion.

7. The tail pipe according to claim 1, wherein the sharply enlarged portion is arranged in a position overlapping with the gently enlarged portion in the circumferential direction of the inner pipe.

8. The tail pipe according to claim 3, wherein the at least one communication hole has a teardrop shape.

* * * * *